US012435404B2

(12) United States Patent
Hwang et al.

(10) Patent No.: US 12,435,404 B2
(45) Date of Patent: Oct. 7, 2025

(54) ALUMINUM ALLOY-PLATED STEEL SHEET, HOT-FORMED MEMBER, AND METHODS FOR MANUFACTURING ALUMINUM ALLOY-PLATED STEEL SHEET AND HOT-FORMED MEMBER

(71) Applicant: POSCO, Pohang-si (KR)

(72) Inventors: Hyeon-Seok Hwang, Gwangyang-si (KR); Suk-Kyu Lee, Gwangyang-si (KR); Jong-Gi Oh, Gwangyang-si (KR); Kwang-Tai Min, Gwangyang-si (KR); Dong-Seok Shin, Gwangyang-si (KR)

(73) Assignee: POSCO, Pohang-si (KR)

( * ) Notice: Subject to any disclaimer, the term of this patent is extended or adjusted under 35 U.S.C. 154(b) by 578 days.

(21) Appl. No.: 17/765,306

(22) PCT Filed: Dec. 11, 2020

(86) PCT No.: PCT/KR2020/018115

§ 371 (c)(1),
(2) Date: Mar. 30, 2022

(87) PCT Pub. No.: WO2021/125696

PCT Pub. Date: Jun. 24, 2021

(65) Prior Publication Data

US 2022/0372608 A1 Nov. 24, 2022

(30) Foreign Application Priority Data

Dec. 18, 2019 (KR) ..... 10-2019-0170140

(51) Int. Cl.

| | |
|---|---|
| ***C23C 2/12*** | (2006.01) |
| ***C22C 21/10*** | (2006.01) |
| ***C22C 38/00*** | (2006.01) |
| ***C22C 38/04*** | (2006.01) |
| ***C22C 38/14*** | (2006.01) |
| ***C23C 2/28*** | (2006.01) |
| ***C23C 2/40*** | (2006.01) |

(52) U.S. Cl.

CPC ..... *C23C 2/12* (2013.01); *C22C 21/10* (2013.01); *C22C 38/002* (2013.01); *C22C 38/04* (2013.01); *C22C 38/14* (2013.01); *C23C 2/28* (2013.01); *C23C 2/29* (2022.08); *C23C 2/40* (2013.01); *C21D 2211/002* (2013.01); *C21D 2211/005* (2013.01); *C21D 2211/008* (2013.01)

(58) Field of Classification Search

CPC .... C23C 2/12; C23C 2/28; C23C 2/29; C23C 2/40; C23C 2/20; C23C 2/50; C23C 30/00; C23C 2/0222; C23C 2/52; C22C 21/10; C22C 38/002; C22C 38/04; C22C 38/14; C22C 38/02; C21D 2211/002; C21D 2211/005; C21D 2211/008; C21D 1/18; C21D 1/26; C21D 1/673; C21D 1/76; C21D 7/13; C21D 8/0205; C21D 8/0247; C21D 8/0278; C21D 9/46; C21D 8/0226; B32B 15/012

See application file for complete search history.

(56) References Cited

U.S. PATENT DOCUMENTS

| | | | |
|---|---|---|---|
| 2014/0377583 | A1 | 12/2014 | Tsuru et al. |
| 2017/0260601 | A1 | 9/2017 | Banik et al. |
| 2018/0216218 | A1 | 8/2018 | Machado Amorim et al. |
| 2018/0223386 | A1 | 8/2018 | Machado Amorim et al. |
| 2020/0024708 | A1 | 1/2020 | Sengoku et al. |
| 2020/0087747 | A1 | 3/2020 | Kim et al. |
| 2020/0262181 | A1 | 8/2020 | Kim et al. |
| 2021/0008837 | A1* | 1/2021 | Hwang ..... C22C 38/02 |

FOREIGN PATENT DOCUMENTS

| | | | |
|---|---|---|---|
| CN | 107849628 | A | 3/2018 |
| CN | 108431269 | A | 8/2018 |
| CN | 110114500 | A | 8/2019 |
| EP | 3730664 | A1 | 10/2020 |
| EP | 3730665 | A1 | 10/2020 |
| JP | 2000-328214 | A | 11/2000 |
| JP | 2001-303229 | A | 10/2001 |
| JP | 2013-122079 | A | 6/2013 |
| KR | 10-2015-0074882 | A | 7/2015 |
| KR | 10-2017-0048542 | A | 5/2017 |

(Continued)

OTHER PUBLICATIONS

International Search Report dated May 27, 2021 issued in International Patent Application No. PCT/KR2020/018115 (with English translation).

(Continued)

*Primary Examiner* — Sally A Merkling

*Assistant Examiner* — Danny N Kang

(74) *Attorney, Agent, or Firm* — Morgan Lewis & Bockius LLP

(57) ABSTRACT

Embodiments of the present disclosure provides an aluminum alloy-plated steel sheet having high surface quality and weldability, a hot-formed member, and methods for manufacturing the aluminum alloy-plated steel sheet and the hot-formed member. The aluminum alloy-plated steel sheet includes: a base steel sheet; and an aluminum alloy plating layer formed on the base steel sheet, wherein the aluminum alloy plating layer includes, by weight %, Zn: 21% to 35%, Si: 1% to 6.9%, Fe: 2% to 12%, and the balance of Al and inevitable impurities.

3 Claims, No Drawings

(56) References Cited

FOREIGN PATENT DOCUMENTS

| | | | |
|---|---|---|---|
| KR | 10-2018-0022929 | A | 3/2018 |
| KR | 10-2019-0076129 | A | 7/2019 |
| KR | 10-2019-0076796 | A | 7/2019 |
| KR | 10-2019-0078438 | A | 7/2019 |
| KR | 10-2019-0105115 | A | 9/2019 |
| WO | 2014/196645 | A1 | 12/2014 |
| WO | 2017/017514 | A1 | 2/2017 |
| WO | 2018/179397 | A1 | 10/2018 |

OTHER PUBLICATIONS

Extended European Search Report dated Nov. 23, 2022 issued in European Patent Application No. 20901128.7.
Rejection Decision dated Mar. 5, 2024 issued in Chinese Patent Application No. CN 202080084510.5.
Pre-Appeal Report dated May 2, 2024 issued in Japanese Patent Application No. JP 2022-519555.
Wang, K., et al., "Metal Coating Technology", Metallurgical Industry Press, Sep. 2014, pp. 1-7, see English Translation.
Chinese Office Action dated Mar. 25, 2023 issued in Chinese Patent Application No. 202080084510.5.
Japanese Office Action dated Feb. 14, 2023 issued in Japanese Patent Application No. 2022-519555.
Office Action dated Mar. 18, 2025 issued in corresponding Japanese Patent Application No. 2022-519555. (Note: JP 2000-328214 A already submitted.).

* cited by examiner

ALUMINUM ALLOY-PLATED STEEL SHEET, HOT-FORMED MEMBER, AND METHODS FOR MANUFACTURING ALUMINUM ALLOY-PLATED STEEL SHEET AND HOT-FORMED MEMBER

CROSS-REFERENCE OF RELATED APPLICATIONS

This application is the U.S. National Phase under 35 U.S.C. § 371 of International Patent Application No. PCT/KR2020/018115, filed on Dec. 11, 2020, which in turn claims the benefit of Korean Application No. 10-2019-0170140, filed on Dec. 18, 2019, the entire disclosures of which applications are incorporated by reference herein.

TECHNICAL FIELD

The present disclosure relates to an aluminum alloy-plated steel sheet, a hot-formed member, and methods for manufacturing the aluminum alloy-plated steel sheet and the hot-formed member, and more particularly, to an aluminum alloy-plated steel sheet having high surface quality and weldability and preferable for application to automotive steel sheets, a hot-formed member, and methods for manufacturing the aluminum alloy-plated steel sheet and the hot-formed member.

BACKGROUND ART

Aluminum-plated steel sheets do not have sacrificial corrosion resistance and thus have poor corrosion resistance, for example, when scratched. In addition, when manufacturing aluminum-plated steel sheets, due to a relatively high melting point of aluminum in a plating bath, equipment such as sink rolls immersed in the plating bath may be eroded by molten aluminum during manufacturing processes, resulting in a short equipment replacement cycle and poor productivity.

Although zinc-based plated steel sheets have high corrosion resistance, zinc-based plated steel sheets have very poor weldability because zinc oxide is thickly formed on the surface of a plating layer after a hot press forming process. Thus, secondary processing such as shot blasting for removing oxides from the plating layer is required for a welding process.

DISCLOSURE

Technical Problem

Aspects of the present disclosure may provide an aluminum alloy-plated steel sheet having high surface quality and weldability, a hot-formed member, and methods for manufacturing the aluminum alloy-plated steel sheet and the hot-formed member.

Technical Solution

According to an aspect of the present disclosure, an aluminum alloy-plated steel sheet may include: a base steel sheet; and an aluminum alloy plating layer formed on the base steel sheet, wherein the aluminum alloy plating layer may include, by weight %, Zn: 21% to 35%, Si: 1% to 6.9%, Fe: 2% to 12%, and the balance of Al and inevitable impurities.

According to another aspect of the present disclosure, a hot-formed member may be obtained by hot forming an aluminum alloy-plated steel sheet, the aluminum alloy-plated steel sheet including a base steel sheet and an aluminum alloy plating layer formed on the base steel sheet, wherein the aluminum alloy plating layer may include, by weight %, Zn: 21% to 35%, Si: 1% to 6.9%, Fe: 2% to 12%, Mg: 1.2% or less (including 0%), and the balance of Al and inevitable impurities, and the hot-formed member may have a microstructure including, in area %, 90% or more martensite and at least one of ferrite and bainite as a remainder.

According to another aspect of the present disclosure, a method for manufacturing an aluminum alloy-plated steel sheet may include: preparing a base steel sheet; and forming an aluminum alloy plating layer on each surface of the base steel sheet by dipping the base steel sheet in a plating bath having a temperature of 580° C. to 680° C., wherein the plating bath may include, by weight %, Zn: 23% to 40%, Si: 1% to 8%, and the balance of Al and inevitable impurities.

According to another aspect of the present disclosure, a method for manufacturing a hot-formed member may include: heating the aluminum alloy-plated steel sheet obtained by the method of the aspect of the present disclosure to an Ac3 temperature or higher; obtaining a hot-formed member by hot forming the heated aluminum alloy-plated steel sheet by using a die; and cooling the hot-formed member at a cooling rate of 10° C./s or more.

Advantageous Effects

Aspects of the present disclosure provide an aluminum alloy-plated steel sheet having high surface quality and weldability, a hot-formed member, and methods for manufacturing the aluminum alloy-plated steel sheet and the hot-formed member.

BEST MODE

Hereinafter, an aluminum alloy-plated steel sheet will be described according to an embodiment of the present disclosure.

According to the embodiment of the present disclosure, the aluminum alloy-plated steel sheet includes a base steel sheet and an aluminum alloy plating layer formed on the base steel sheet.

In the present disclosure, the type or composition of the base steel sheet is not particularly limited. However, for example, the base steel sheet may be a hot-rolled steel sheet, a hot-rolled pickled steel sheet, a cold-rolled steel sheet, or the like, and may include, by weight %, C: 0.15% to 0.39%, Mn: 0.5% to 3%, B: 0.01% or less (including 0%), Ti: 0.1% or less (including 0%), and the balance of Fe and inevitable impurities. In addition, the base steel sheet of the present disclosure may further include Si, Cr, or the like in an amount common in the art.

C: 0.15% to 0.39%

C increases the strength and hardness of a material, has an effect of inhibiting the transformation of austenite into ferrite and pearlite in a blank heated to a high temperature, and helps to secure strength during a hot press forming process. In addition, C has an effect of lowering a martensite start temperature, thereby improving die cooling efficiency. To this end, the content of C is preferably 0.15% or more. However, when the content of C exceeds 0.39%, weldability deteriorates, and the ductility of a final product decreases. Therefore, the content of C is preferably within the range of 0.15% to 0.39%. The lower limit of the content of C may be more preferably 0.17%, even more preferably 0.19%, and most preferably 0.21%. The upper limit of the content of C may be more preferably 0.37%, even more preferably 0.35%, and most preferably 0.33%.

Mn: 0.5% to 3%

Mn has an effect of securing hardenability of the base steel sheet and lowering the austenite transformation temperature of the base steel sheet, and thus the temperature of a furnace may be lowered during a hot press forming process. In addition, Mn improves strength because Mn suppresses the formation of bainite and facilitates the formation of martensite in a final product after a hot press forming process. In addition, Mn may lower a martensitic start (Ms) temperature. If the content of Mn is less than 0.5%, it is difficult to obtain a sufficient austenite fraction by heating in a general furnace, and thus sufficient strength may not be obtained because of poor hardenability after a hot press forming process. If the content of Mn is greater than 3%, material cracking may occur during quenching in a hot press forming process. Therefore, the content of Mn is preferably within the range of 0.5% to 3%. The lower limit of the content of Mn may be more preferably 0.8%, still more preferably 1.0%, and most preferably 1.2%. The upper limit of the content of Mn may be more preferably 2.5%, even more preferably 2.0%, and most preferably 1.8%.

B: 0.01% or less (including 0%)

B is an element for effectively securing hardenability. Even a very small amount of B may increase strength, and B has an effect of suppressing the formation of ferrite and pearlite and increasing the fraction of martensite during cooling in a hot press forming process. However, if the content of B exceeds 0.01%, B concentrates on a surface and forms oxides during annealing for a plating process. This lowers wettability to a plating bath, and thus increases the possibility of plating failure and results in poor surface quality. Therefore, the content of B is preferably within the range of 0.01% or less. The lower limit of the content of B is more preferably 0.0005% (5 ppm), even more preferably 0.0010 (10 ppm) %, and most preferably 0.0015% (15 ppm). The upper limit of the content of B is more preferably 0.008% (80 ppm), and even more preferably 0.005% (50 ppm).

Ti: 0.1% or less (including 0%)

Titanium (Ti) combines with nitrogen (N) and forms a nitride, thereby having an effect of preventing a decrease in hardenability which may be caused by the formation of BN. In addition, Ti has a function of facilitating austenite refinement during heating for a hot press forming process, thereby increasing the toughness of the base steel sheet. However, when the content of Ti exceeds 0.1%, this effect is saturated, and the toughness of steel is lowered due to excessive precipitation of Ti nitride. Thus, it is preferable that the content of Ti is within the range of 0.1% or less. In addition, it is more preferable that the content of Ti is 0.01% or more.

Preferably, the aluminum alloy plating layer includes, by weight %, Zn: 21% to 35%, Si: 1% to 6.9%, Fe: 2% to 12%, and the balance of Al and inevitable impurities.

In general, aluminum-plated steel sheets basically does not have sacrificial corrosion resistance, and thus Zn is added to improve corrosion resistance. In addition, Zn lowers a melting point in a plating bath. The content of Zn is preferably 21% to 35%. However, when the content of Zn is less than 21%, corrosion resistance is not sufficiently secured. When the content of Zn exceeds 35%, a melting point in a plating bath is low and the content of Zn is relatively high, which causes evaporation of Zn, forms ash of Zn evaporating and adhering to a snout, and results in serious surface quality problems due to ash of Zn adhering to the base steel sheet during a plating process. Therefore, the content of Zn is preferably within the range of 21% to 35%. The lower limit of the content of Zn may be more preferably 22%, more preferably more than 24%, and most preferably 25%. The upper limit of the content of Zn may be more preferably 34%, even more preferably 33%, and most preferably 32%.

Si suppresses a reaction between Al in a plating bath and Fe in the base steel sheet and thus excessive formation of an intermetallic compound layer, and also has a function of lowering a melting point in a plating bath. It is preferable that the content of Si is 1% to 6.9%. When the content of Si is less than 1%, Si does not have the effect of suppressing an alloying reaction, and thus an aluminum diffusion layer is thickly formed by diffusion of Al into Fe of the base steel sheet, thereby deteriorating weldability. In addition, an uneven interface is formed between the base steel sheet and the aluminum alloy plating layer, which negatively affects the surface of the aluminum alloy plating layer and thus results in poor surface quality. When the content of Si is excessive, a melting point in a plating bath is high, and thus surface defects may occur. In an aluminum plating bath containing 30% zinc, the eutectic point of Si and Al is 6.9%, and when the content of Si exceeds 6.9%, a melting point in a plating bath increases steeply as the content of Si exceeds the Al—Si eutectic composition including Zn, thereby causing a rapid formation of ash in the plating bath. In addition, when the content of Si exceeds 6.9%, an uneven surface is formed on the aluminum alloy plating layer because Si precipitates earlier than Al when the aluminum alloy plating layer starts to solidify on the surface of the base steel sheet outside the plating bath. Accordingly, the content of Si is preferably within the range of 1% to 6.9%. The lower limit of the content of Si may be more preferably 1.1%, even more preferably 1.5%, and most preferably 2%. The upper limit of the content of Si may be more preferably 6.5%, even more preferably 6.0%, and most preferably less than 5.0%.

The content of Fe in the aluminum alloy plating layer is preferably 2% to 12%, and when the content of Fe is less than 2%, Al in a plating bath and Fe of the base steel sheet do not form a uniform Al—Fe alloy phase on the surface of the base steel sheet, but form a non-uniform Al—Fe alloy phase or do not form an Al—Fe alloy phase on the surface of the base steel sheet, thereby causing the formation of a rough plating surface and increasing plating defects. When the content of Fe exceeds 12%, an Al—Fe alloy layer is excessively formed, and thus the aluminum alloy plating layer may be separated because of a surface alloy phase having low ductility. In addition, an alloy phase excessively formed during a plating process may suppress the diffusion of Fe in a heat treatment process which is performed during a hot press forming process, thereby causing the plating layer to remain in a liquid state for a long time and fuse to a heating furnace. Therefore, the content of Fe is preferably within the range of 2% to 12%. The lower limit of the content of Fe may be more preferably 3%, even more preferably 4%, and most preferably more than 5%. The upper limit of the content of Fe may be more preferably 12%, even more preferably 11.5%, and most preferably 11%. Although Fe is not contained in a plating bath, Fe of the base steel sheet is eluted into the plating bath during a plating process and may thus be included in the aluminum alloy plating layer.

In addition, optionally, the aluminum alloy plating layer may further include Mg in an amount of 1.4% or less to improve corrosion resistance. Mg improves corrosion resistance by functioning as a buffer which prevents zinc oxides from additionally decomposing in a corrosive environment. Therefore, the content of Mg is preferably within the range of 1.4% or less. However, when the content of Mg exceeds 1.4%, weldability is likely to deteriorate. The lower limit of the content of Mg may be more preferably 0.05%, even more preferably 0.1%, and most preferably 0.15%. The upper limit of the content of Mg may be more preferably 1.2%, even more preferably 1.0%, and most preferably 0.8%.

Furthermore, in the aluminum alloy plating layer, Al/(Zn+Si) may be within the range of 1.3 to 2.6. Al/(Zn+Si) is controlled to guarantee weldability and corrosion resistance. Zn improves corrosion resistance, but an excessive addition of Zn results in the formation of surface zinc oxide after a hot press forming process and thus deteriorates weldability. If Si is added in a small amount, weldability deteriorates because an aluminum diffusion layer is thickly formed. If Si is added in an amount equal to or greater than a eutectic point, the melting point in a plating bath increases. When Al/(Zn+Si) is less than 1.3, weldability deteriorates, and when Al/(Zn+Si) exceeds 2.6, corrosion resistance deteriorates unless Mn is added. Therefore, Al/(Zn+Si) is preferably adjusted to be within the range of 1.3 to 2.6. The lower limit of Al/(Zn+Si) may be more preferably 1.35, even more preferably 1.40, and most preferably 1.45. The upper limit of Al/(Zn+Si) may be more preferably 2.55, even more preferably 2.5, and most preferably 2.45. In the description above, the contents of Al, Zn and Si are in weight %.

As described above, the aluminum alloy-plated steel sheet of the present disclosure has not only high corrosion resistance, but also high surface quality and high weldability.

Hereinafter, a hot-formed member will be described according to an embodiment of the present disclosure.

The hot-formed member of the embodiment of the present disclosure is obtained by hot forming the aluminum alloy-plated steel sheet having the above-described characteristics, and may preferably have a microstructure including, in area %, 90% or more martensite and at least one of ferrite and bainite as a remainder. Martensite is a microstructure which is very advantageous for securing strength, and in the present disclosure, the fraction of martensite is adjusted to be 90% or more. When the fraction of martensite is less than 90%, it is difficult to secure sufficient strength. Therefore, it is preferable that the fraction of martensite is 90% or more. The fraction of martensite may be more preferably 93% or more, even more preferably 95% or more, and most preferably 97% or more. In addition, the most preferable fraction of martensite is 100% in terms of strength. In this case, however, microstructures such as ferrite and bainite may be inevitably formed as impure microstructures during manufacturing processes.

The hot-formed member of the present disclosure which is provided as described above may have a tensile strength of 1200 MPa or more, that is, very high strength.

Hereinafter, a method for manufacturing an aluminum alloy-plated steel sheet will be described according to an embodiment of the present disclosure.

First, a base steel sheet is prepared. When preparing the steel sheet, a degreasing, cleaning, or pickling process may be performed on the base steel sheet to clean the surface of the base steel sheet by removing impurities such as oil from the surface of the base steel sheet.

Thereafter, the base steel sheet may be heat treated at 650° C. to 850° C. The heat treatment may be performed at a temperature equal to or higher than the recrystallization temperature of the base steel sheet to prevent work hardening of the base steel sheet in a continuous plating process and to maintain the base steel sheet at a temperature higher than the temperature of a plating bath for improving plating characteristics. If the heat treatment temperature is less than 650° C., the base steel sheet may meander or deform because of work hardening while passes through rolls, for example, in a continuous process, and when the heat treatment temperature exceeds 850° C., Mn and Si included in the base steel sheet may concentrate on the surface of the base steel sheet and form oxides which deteriorate plating characteristics. Therefore, the heat treatment temperature is preferably 650° C. to 850° C. The lower limit of the heat treatment temperature may be more preferably 680° C., even more preferably 700° C., and most preferably 730° C. The upper limit of the heat treatment temperature may be more preferably 850° C., even more preferably 830° C., and most preferably 810° C.

The heat treatment may be performed in a reducing atmosphere including, in volume %, hydrogen gas in an amount of 25% or less (including 0%) and the balance of nitrogen gas. If high-purity nitrogen gas is not used, the surface of the base steel sheet may not be cleaned because it is difficult to maintain the reducing atmosphere in a heat treatment furnace. In this case, however, the addition of hydrogen gas may lower the dew point in the heat treatment furnace and maintain the reducing atmosphere, thereby preventing additional oxidation of the base steel sheet and cleaning the base steel sheet. However, when the amount of hydrogen gas exceeds 25%, there is a risk of explosion of the heat treatment furnace if the hydrogen gas leaks to the air and makes contact with oxygen. The upper limit of the amount of hydrogen gas may be more preferably 20%, even more preferably 15%, and most preferably 10%. In addition, the lower limit of hydrogen gas may be more preferably 0.5%, even more preferably 1%, and most preferably 2%.

Then, the base steel sheet is dipped in the plating bath having a temperature of 560° C. to 680° C. to form an aluminum alloy plating layer on the surface of the base steel sheet. When the temperature of the plating bath is less than 560° C., the temperature of the plating bath is low and the viscosity inside the plating bath increases, thereby making it difficult to operate equipment such as sink rolls immersed in the plating bath and resulting in poor operability. When the temperature of the plating bath exceeds 680° C., product surface quality may deteriorate because of ash formed in or from the plating bath containing Zn, and equipment such as sink rolls may be considerably eroded in the plating bath to result in a short equipment replacement cycle. Therefore, the temperature of the plating bath is preferably within the range of 560° C. to 680° C. The lower limit of the temperature of the plating bath may be more preferably 565° C., even more preferably 570° C., and most preferably 575° C. The upper limit of the temperature of the plating bath may be more preferably 675° C., even more preferably 665° C., and most preferably 650° C.

In this case, the plating bath may preferably contain, by weight %, Zn: 23% to 40%, Si: 1% to 8%, and the balance of Al and inevitable impurities.

The content of Zn is preferably 23% to 40%. If the content of Zn is less than 23%, corrosion resistance is not sufficiently secured. If the content of Zn exceeds 40%, the melting point in the plating bath is lowered, which causes evaporation of Zn, forms ash of Zn evaporating and adhering to a snout, and results in serious surface quality problems due to ash of Zn adhering to the base steel sheet during a plating process. Therefore, the content of Zn is preferably within the range of 23 to 40%. The lower limit of the Zn content may be more preferably 24%, even more preferably 25%, and most preferably 26%. The upper limit of the Zn content may be more preferably 39%, still more preferably 38%, and most preferably 37%. In addition, the content of Zn in the plating bath is higher than the content of Zn in the aluminum alloy plating layer because Fe eluted from the base steel sheet is included in the aluminum alloy plating layer instead of Zn in the plating bath. That is, to adjust the content of Zn in the aluminum alloy plating layer to be a value proposed in the present disclosure, it is required to adjust the content of Zn in the plating bath to be higher than the content of Zn in the aluminum alloy plating layer.

It is preferable that the content of Si is 1% to 8%. When the content of Si is less than 1%, Si does not have an effect of suppressing an alloying reaction, and thus an aluminum diffusion layer is thickly formed by diffusion of Al into Fe of the base steel sheet, thereby deteriorating weldability. In addition, an uneven interface is formed between the base steel sheet and the aluminum alloy plating layer, which negatively affects the surface of the aluminum alloy plating layer and thus results in poor surface quality. When the content of Si is excessive, the melting point in the plating bath is high, and thus surface defects may occur. In an aluminum plating bath containing 30% zinc, the eutectic point of Si and Al is 6.9%, and when the content of Si exceeds 8%, the melting point in the plating bath increases steeply as the content of Si exceeds the Al—Si eutectic composition including Zn, causing a rapid formation ash in the plating bath. In addition, when the content of Si exceeds 86.9%, an uneven surface is formed on the plating layer because Si precipitates earlier than Al when the plating layer starts to solidify on the surface of the base steel sheet outside the plating bath. Accordingly, the content of Si is preferably within the range of 1% to 8%. The lower limit of the content of Si may be more preferably 1.1%, even more preferably 1.5%, and most preferably 2%. The upper limit of the content of Si may be more preferably 6.5%, even more preferably 6.0%, and most preferably less than 5.0%.

In addition, optionally, the plating bath may further include Mg in an amount of 1.4% or less to improve corrosion resistance. Mg improves corrosion resistance by functioning as a buffer which prevents zinc oxides from additionally decomposing in a corrosive environment. Therefore, the content of Mg is preferably within the range of 1.4% or less. However, when the content of Mg exceeds 1.4%, weldability is likely to deteriorate. The lower limit of the content of Mg may be more preferably 0.05%, even more preferably 0.1%, and most preferably 0.15%. The upper limit of the content of Mg may be more preferably 1.2%, even more preferably 1.0%, and most preferably 0.8%.

The temperature of the plating bath is preferably within the range of a plating liquid melting point+20° C. to a plating liquid melting point+80° C. As described above, when the temperature of the plating bath is adjusted to be higher than the melting point of the plating liquid by 20° C. to 80° C., the drivability of sink rolls in the plating bath may be improved. In general, the viscosity of the plating liquid has an inverse relationship with the temperature of the plating bath, and as the temperature of the plating bath increases, the viscosity of the plating liquid decreases, improving plating workability. However, when the temperature of the plating bath is less than the plating liquid melting point+20° C., the drivability of sink rolls is poor, making it difficult to control the tension of the sink rolls and increasing the possibility of product surface defects caused by vibration of the sink rolls or the like. In addition, when the temperature of the plating bath exceeds the plating liquid melting point +80° C., surface defects may occur due to the evaporation of Zn, and equipment may deteriorate because of high temperature.

When the base steel sheet is dipped in the plating bath, the temperature of the base steel sheet at an inlet of the plating bath may be within the range of the temperature of the plating bath +5° C. to the temperature of the plating bath +50° C. As described above, the temperature of the base steel sheet at the inlet of the plating bath may be adjusted to be higher than the temperature of the plating bath by 5° C. to 50° C. so as to prevent a decrease in the temperature of the plating bath. If the temperature of the base steel sheet at the inlet of the plating bath is less than the temperature of the plating bath +5° C., an alloying reaction between the plating bath and the base steel sheet may be delayed, causing poor plating adhesion, and if the temperature of the base steel sheet at the inlet of the plating bath exceeds the temperature of the plating bath +50° C., it may be difficult to control the temperature of the plating bath because the temperature of the plating bath increases due to heat transferred from the base steel sheet.

In addition, a process of controlling the plating amount of the aluminum alloy plating layer may be further performed after the process of forming the aluminum alloy plating layer. The plating amount may be controlled using a nozzle which is known as an air knife and capable of blowing gas. The plating amount is adjusted to be within the range of 15 $g/m^2$ to 150 $g/m^2$ based on one side of the base steel sheet. If the plating amount is less than 15 $g/m^2$, it may be difficult to secure sufficient corrosion resistance, and if the plating amount exceeds 150 $g/m^2$, problems such as surface defects and fusing of the aluminum alloy plating layer onto a die may occur because non-uniform alloying locally occurs due to plating amount deviations caused by flow patterns or the like. The lower limit of the plating amount is more preferably 25 $g/m^2$, and the upper limit of the plating amount is more preferably 100 $g/m^2$.

Hereinafter, a method for manufacturing a hot-formed member will be described according to an embodiment of the present disclosure.

First, an aluminum alloy-plated steel sheet prepared by the method described above is heated to an Ac3 temperature or higher. The heating is for forming the microstructure of the aluminum alloy-plated steel sheet as austenite. If the temperature of heating is less than the Ac3 temperature, the aluminum alloy-plated steel sheet is heated in a dual phase region of austenite+ferrite, and thus austenite is not sufficiently formed. In addition, the heating may be performed for 1 minute to 15 minutes. If the heating time is less than 1 minute, austenite may not be sufficiently formed. If the heating time exceeds 15 minutes, heating may be uselessly performed even after transformation into austenite is completed, increasing production costs and production time and decreasing productivity. The lower limit of the heating time may be more preferably 1.5 minutes, still more preferably 2 minutes, and most preferably 2.5 minutes. The upper limit of the heating time may be more preferably 12 minutes, even more preferably 10 minutes, and most preferably 8 minutes.

In addition, before the heating, a process of manufacturing the aluminum alloy-plated steel sheet as a blank may be additionally performed. The blank may be manufactured according to a finally intended shape, and thus the blank manufacturing process is not particularly specified in the present disclosure.

After the heating process, a hot forming process is performed on the heated aluminum alloy-plated steel sheet by using a die to obtain a hot-formed member. In the present disclosure, the hot forming process is not particularly specified, and any process commonly used in the art may be used as the hot forming process.

In addition, when transferring the heated aluminum alloy-plated steel sheet to the die, the time of transfer may be adjusted to be 20 seconds or less. If the time of transfer exceeds 20 seconds, the temperature of the heated aluminum alloy-plated steel sheet decreases during transfer and may thus be equal to or lower than an Ms temperature at the die. Thus, transformation into martensite may not smoothly occur, and it may be difficult to secure strength. The time of transfer may be more preferably 18 seconds or less, more preferably 16 seconds or less, and most preferably 15 seconds or less.

Thereafter, the hot-formed member is cooled at a cooling rate of 10° C./s or more. If the cooling rate is less than 10° C./s, martensite is not sufficiently formed, and thus it may be difficult to obtain an intended degree of tensile strength. The cooling rate may be more preferably 15° C./s or more, even more preferably 18° C./s or more, and most preferably 20° C./s or more.

MODE FOR INVENTION

Hereinafter, ideas of the present disclosure will be described in more detail through examples. The examples are merely for illustrating the ideas of the present disclosure in more detail and are not intended to limit the scope of the present disclosure. The scope of the present disclosure is determined by the claims and matters reasonably inferred therefrom.

EXAMPLES

Steel sheets each including, by weight %, C: 0.23%, Mn: 1.3%, B: 0.002%, Ti: 0.03%, Si: 0.25%, Cr: 0.15%, and the balance of Fe and inevitable impurities were heat treated at 800° C. in an atmosphere of a mixture of nitrogen and 5% hydrogen. Then, aluminum alloy plating layers were formed on the steel sheets by dipping the steel sheets into a plating bath under the conditions shown in Table 1 below. Thereafter, aluminum alloy-plated steel sheets were fabricated by controlling the plating amounts of the steel sheets using an air knife under the conditions shown in Table 1. The composition and the plating amount of each of the aluminum alloy plating layers were measured by Inductively Coupled Plasma Optical Emission Spectroscopy (ICP-OES) after dissolving the aluminum alloy plating layers.

Thereafter, after taking specimens from the fabricated aluminum alloy-plated steel sheets, the specimens were sheared as blanks and put into a furnace maintained at 900° C., and after the blank specimens reached 900° C., the blank specimens were maintained for 2 minutes. Thereafter, the heated blank specimens were transferred to a die within 20 seconds, and a hot forming process was performed on the heated blank specimens by using the die to obtain hot-formed members. The hot-formed members were cooled at a cooling rate of 20° C./s. The microstructure, surface quality, corrosion resistance, and weldability of each of the hot-formed members fabricated as described were evaluated. Results thereof are shown in Table 2 below.

Surface qualities were compared by measuring the amount of surface defects caused by zinc ash formed during plating and the amount of ash deposited on specimens separately attached to snout equipment. The amount of zinc ash has a close relationship with the temperature of the plating bath and the content of Zn, but is more significantly affected by the temperature of the plating bath, and thus evaluation was performed as follows, based on Comparative Example 9 having the lowest plating bath temperature.

○: good (the amount of ash is less than 130% of that in Comparative Example 9)

Δ: normal (the amount of ash ranges from 130% to less than 200% of that in Comparative Example 9)

x: poor (the amount of ash is equal to or greater than 200% of that in Comparative Example 9)

Corrosion resistance was compared with that of non-plated steel sheets by performing a test in a corrosive environment inside a salt spray tester until the non-plated steel sheets were corroded. Hot-pressed steel sheets are mainly used as structural members in automobiles, and when such a steel sheet corrodes, fracture occurs in the thinnest part of the steel sheet. Thus, considering this phenomenon, corrosion resistance was evaluated based on the maximum erosion depth by corrosion in each specimen. At that time, to offset a slight difference between the plating amounts of specimens, the depths of cracks in the base steel sheets were normalized using the plating amounts, and then comparison values (normalized crack depths: NCDs) were calculated based on Comparative Example 1 having the deepest crack. In this case, the NCD of Comparative Example 1, which is a reference, was 1, and it could be determined that the smaller the NCD value, the better the corrosion resistance.

◎: 0.5 or less

○: from greater than 0.5 to 0.7

Δ: from greater than 0.7 to 0.9 x: from greater than 0.9 to 1.0

Weldability was evaluated using a 50 Hz spot welding machine according to SEP 1220. Weldability was evaluated by the difference between the maximum welding current and the minimum welding current. The maximum welding current refers to a current related to a splash between sheet materials in a weld zone, that is, a current at which no splash occurred in three successive tests when the current was decreased by 100 A each time. The minimum welding current refers to a current when the diameter of a spot weld zone is $4\ t^{0.5}$ or less (t=steel thickness), and was measured by performing welding five times while increasing the current by 100 A each time. It may be determined that the greater the different between the maximum welding current and the minimum welding current, the better the weldability.

◎: 1 kA or more

○: from 0.6 kA to less than 1 kA

Δ: from greater than 0 kA to less than 0.6 kA x: impossible to measure current due to splashes or the like

TABLE 1

| | Plating bath | | | | | | | Temperature of base | |
|---|---|---|---|---|---|---|---|---|---|
| | Composition (weight %) | | | | | Melting point | Temperature | steel sheet at inlet | Plating amount |
| Examples | Al | Zn | Mg | Si | Al/(Zn + Si) | (° C.) | (° C.) | (° C.) | (g/m$^2$) |
| *CE1 | 91.1 | 0 | 0 | 8.9 | 10.21 | 606 | 660 | 685 | 82 |
| CE2 | 72.4 | 22 | 0 | 5.6 | 2.62 | 583 | 630 | 640 | 62 |
| CE3 | 71.8 | 21 | 0.2 | 6.7 | 2.59 | 581 | 620 | 630 | 57 |
| CE4 | 72.6 | 20.8 | 1.6 | 5 | 2.81 | 578 | 630 | 650 | 66 |
| **IE1 | 69.8 | 26 | 0 | 4.2 | 2.31 | 574 | 620 | 640 | 70 |
| CE5 | 70.2 | 29 | 0 | 0.8 | 2.36 | 594 | 640 | 660 | 54 |
| CE6 | 60.5 | 30.5 | 0 | 9 | 1.53 | 620 | 670 | 690 | 62 |
| IE2 | 65.6 | 29.8 | 1.1 | 3.5 | 1.97 | 574 | 620 | 640 | 55 |
| IE3 | 60 | 35 | 0 | 5 | 1.50 | 549 | 590 | 610 | 67 |
| CE7 | 55 | 41 | 0 | 4 | 1.22 | 546 | 590 | 600 | 49 |
| CE8 | 0.2 | 99.8 | 0 | 0 | 0 | 411 | 460 | 465 | 60 |

*CE: Comparative Example,
**IE : Inventive Example

TABLE 2

| | Aluminum alloy-plated steel sheet | | | | | | Hot-formed member | | Quality properties | | |
|---|---|---|---|---|---|---|---|---|---|---|---|
| | Composition of aluminum alloy plating layer (weight %) | | | | | | Microstructure (area%) | | Surface | Corrosion | |
| Examples | Al | Zn | Mg | Si | Fe | Al/(Zn + Si) | M | Remainder | quality | resistance | Weldability |
| *CE1 | 86.0 | 0 | 0 | 6.3 | 7.7 | 13.65 | 99 | F:1% | ○ | X | ○ |
| CE2 | 70.4 | 20.8 | 0 | 4.9 | 3.9 | 2.74 | 99 | B:1% | ○ | Δ | ○ |
| CE3 | 69.6 | 20.6 | 0.2 | 5.3 | 4.0 | 2.69 | 99 | F:1% | ○ | Δ | ○ |
| CE4 | 69.3 | 20.0 | 1.5 | 5.0 | 4.2 | 2.77 | 98 | B:2% | ○ | ○ | X |
| **IE1 | 67.3 | 25.0 | 0 | 3.7 | 4.0 | 2.34 | 98 | F:1% + B:1% | ○ | ○ | ○ |
| CE5 | 58.2 | 29.0 | 0 | 0.7 | 12.1 | 1.96 | 98 | F:1% + B:1% | Δ | ○ | ○ |
| CE6 | 57.8 | 29.0 | 0 | 8.5 | 4.7 | 1.54 | 99 | B:1% | X | ○ | Δ |
| IE2 | 59.3 | 29.0 | 1.1 | 3.1 | 7.5 | 1.85 | 98 | F:2% | ○ | ○ | ○ |
| IE3 | 55.6 | 33.1 | 0 | 4.8 | 6.5 | 1.47 | 99 | F:1% | ○ | ○ | ○ |
| CE7 | 52.5 | 39.6 | 0 | 3.7 | 4.2 | 1.21 | 99 | F:1%X | X | ◎ | X |
| CE8 | 0.3 | 99.5 | 0 | 0 | 0.2 | 0 | 99 | B:1% | ○ | ◎ | X |

M: martensite, F: ferrite, B: bainite
*CE: Comparative Example,
**IE: Inventive Example As shown in Tables 1 and 2 above, the surface quality, corrosion resistance, and weldability of each of Inventive Examples 1 to 3 satisfying all the conditions proposed in the present disclosure are all good.

However, Comparative Example 1 not including Zn has poor corrosion resistance. Comparative Examples 2 and 3, in which the content of Zn is less than the range proposed in the present disclosure, do not have sufficient corrosion resistance. Although the content of Zn in Comparative Example 4 is less than the range proposed in the present disclosure, Comparative Example 4 has good corrosion resistance because Mg is added thereto. However, Comparative Example 4 has poor weldability because Mg is excessively added. Comparative Example 5 does not have good surface quality and good weldability because the content of Si is less than the range proposed in the present disclosure. Comparative Example 6 does not have good surface quality because the content of Si is greater than the range proposed in the present disclosure. Comparative Example 7 does not have good surface quality and good weldability because the content of Zn is greater than the range proposed in the present disclosure. Comparative Example 8, which is a typical zinc-based plated steel sheet, has good corrosion resistance but has poor weldability due to zinc oxide.

The invention claimed is:

1. An aluminum alloy-plated steel sheet comprising:

a base steel sheet; and an aluminum alloy plating layer formed on the base steel sheet, wherein the aluminum alloy plating layer comprises, by weight %, Zn: 21% to 35%, Si: 1% to 6.9%, Fe: 2% to 12%, and a balance of Al and inevitable impurities, wherein Al/(Zn+Si) of the aluminum alloy plating layer is 1.3 to 2.6, where Al, Zn, and Si respectively refer to Al, Zn, and Si contents in weight %.

2. The aluminum alloy-plated steel sheet of claim 1, wherein the base steel sheet, by weight %, C: 0.15% to 0.39%, Mn: 0.5% to 3%, B: 0.01% or less, Ti: 0.1% or less, and a balance of Fe and inevitable impurities.

3. The aluminum alloy-plated steel sheet of claim 1, wherein the aluminum alloy plating layer further comprises Mg: 1.4% or less.

* * * * *